US006851830B2

(12) United States Patent
Wu

(10) Patent No.: US 6,851,830 B2
(45) Date of Patent: Feb. 8, 2005

(54) ELECTRIC CONNECTING STRUCTURE FOR A LAMP

(76) Inventor: Wen-Chang Wu, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/356,023

(22) Filed: Feb. 3, 2003

(65) Prior Publication Data

US 2004/0151001 A1 Aug. 5, 2004

(51) Int. Cl.[7] ..... H01R 33/00

(52) U.S. Cl. ..... 362/226; 362/391; 362/376; 403/321; 439/350

(58) Field of Search ..... 362/145, 147, 362/226, 227, 249, 254, 362, 368, 370, 382, 391, 396, 403, 404, 405, 406; 403/187, 192, 193, 197, 230, 233, 235, 236, 263, 321, 325; 439/207, 208, 210, 211, 296, 304, 325, 327, 328, 345, 350, 353

(56) References Cited

U.S. PATENT DOCUMENTS 1,045,273 A * 11/1912 Fisher ..... 362/405
1,298,858 A * 4/1919 Anthony ..... 439/353
1,646,807 A * 10/1927 Benjamin ..... 439/353
4,079,244 A * 3/1978 Bortoluzzi ..... 362/405
6,517,223 B2 * 2/2003 Hsu ..... 362/405
6,612,531 B2 * 9/2003 Wu ..... 362/405
6,685,346 B2 * 2/2004 Wu ..... 362/405

* cited by examiner

*Primary Examiner*—Thomas M. Sember
*Assistant Examiner*—Ismael Negron

(57) ABSTRACT

An electric connecting structure serves for assembling a lamp rod to a wire connecting box. The electric connecting structure comprises: a plurality of wire connecting boxes; a plurality of retaining seats; a receptacle at rear sides of retaining seats; a plurality of braking pieces; and a plurality of connectors. Each connector is embedded into a connecting hole of the retaining seat; and the braking pieces are buckled to a bottom of the braking inclined surface so that the connector is positioned firmly. Therefore, the ceiling lamp is formed by above components and assembly way. Furthermore, in assembly, the lamp rod is inserted into the wire connecting box so that the connector and the retaining seat are connected correctly. Thus, the main rod and wire connecting boxes of the ceiling lamp are engaged correctly by an automatic calibration function.

7 Claims, 10 Drawing Sheets

ELECTRIC CONNECTING STRUCTURE FOR A LAMP

FIELD OF THE INVENTION

The present invention relates to connecting structures for lamps, and particularly to an electric connecting structure for a lamp, in that the main rod and wire connecting boxes of the ceiling lamp are engaged correctly by an automatic calibration function.

BACKGROUND OF THE INVENTION

Currently, the way for assembly a ceiling lamp is classified into a singe stage way and a multiple stage way. Since the tube of the lamp is installed with electric wires, for easily installing the tube, before sold, the lamp rod and the wire connecting box are connected so that the volume of the lamp is large and thus the cost is high. Thereby, there is an eager demand for a novel electric connecting structure for a lamp which can be assembled by the user himself (herself) so as to reduce the volume in package and reduce the cost in transfer.

SUMMARY OF THE INVENTION

Accordingly, the primary object of the present invention is to provide an electric connecting structure for a lamp for assembling a lamp rod and wire connecting boxes. The electric connecting structure comprises the following elements. A plurality of wire connecting boxes each of the wire connecting box has a plurality of inserting holes annularly arranged around a periphery of the wire connecting box. An inner side of each wire connecting box is installed with a retaining seat. A connecting hole is formed axially in the retaining seat. A plurality of retaining seats. A receptacle is at rear sides of retaining seats. A conductive seat is installed in the receptacle; each of two sides of the receptacle having a through hole. A positioning screw passes through each of the through hole so as to lock the receptacle into the positioning holes of the retaining seats. A plurality of braking pieces are mounted to respective retaining seats. Each connector is locked to a lamp rod. Each connector has a braking inclined surface at a rear side thereof. A channel is formed at a middle section of the braking inclined surface. A front end of the channel has a stop wall. Each of the two sides of the channel is formed with at least one via hole; and the front end thereof has a stop edge.

The various objects and advantages of the present invention will be more readily understood from the following detailed description when read in conjunction with the appended drawing.

BRIEF DESCRIPTION OF THE PREFERRED EMBODIMENTS

In the following, two embodiments about the electric connecting structure for a lamp of the present invention will be described herein.

Figure 1:
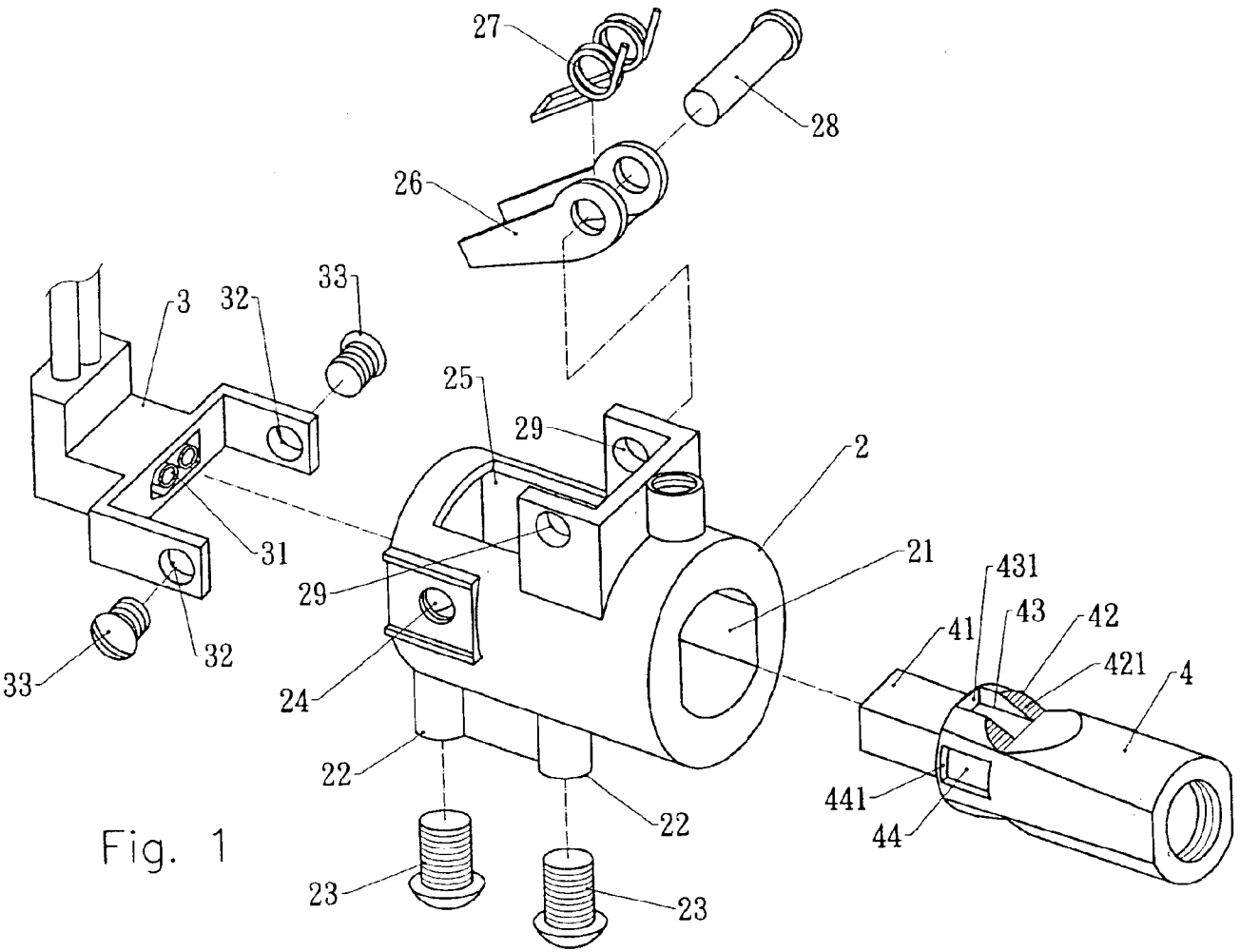
FIG. 1 is an exploded perspective view of the retaining seat in the first embodiment of the present invention.
Figure 1A:
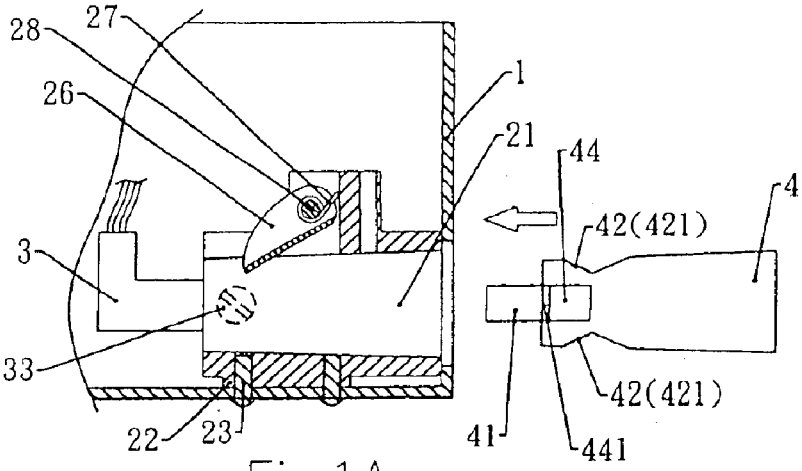
FIGS. 1A to 1F are exploded perspective views showing the insertion actions of the first embodiment.
Figure 1B:
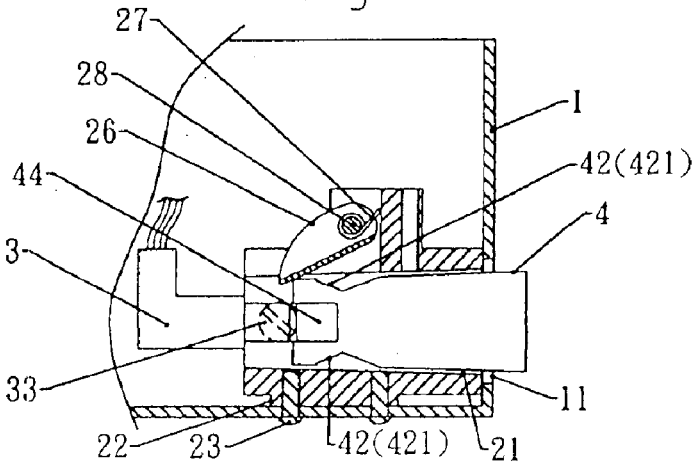
Figure 1C:
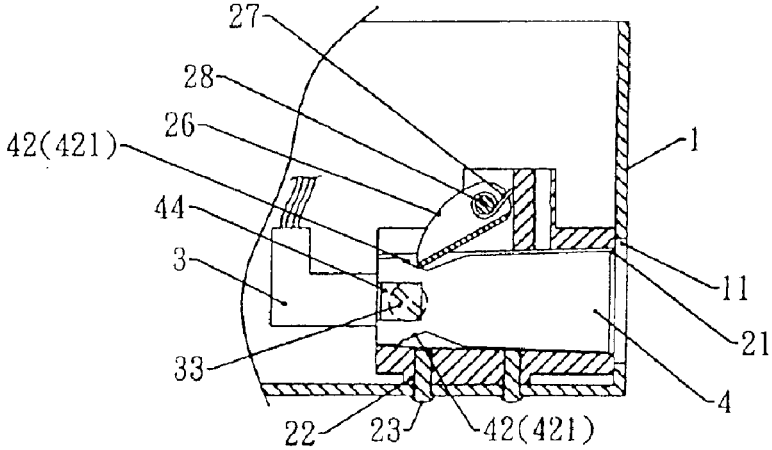
Figure 1D:
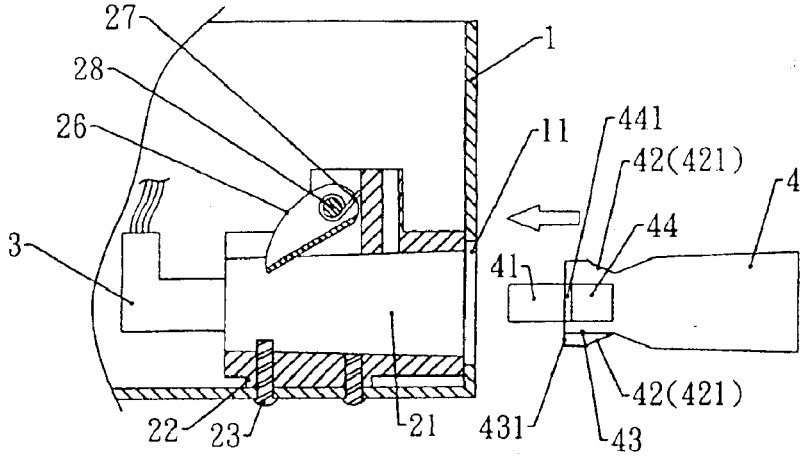
Figure 1E:
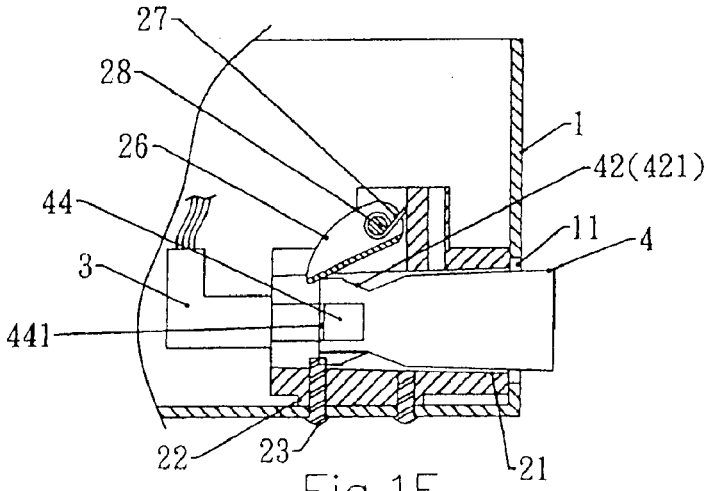
Figure 1F:
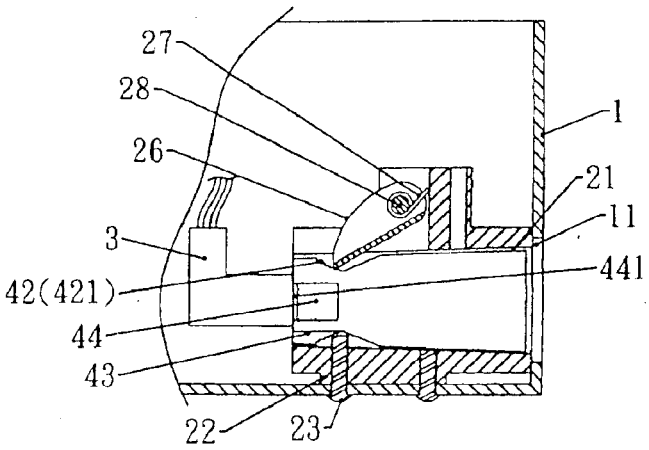
Figure 2:
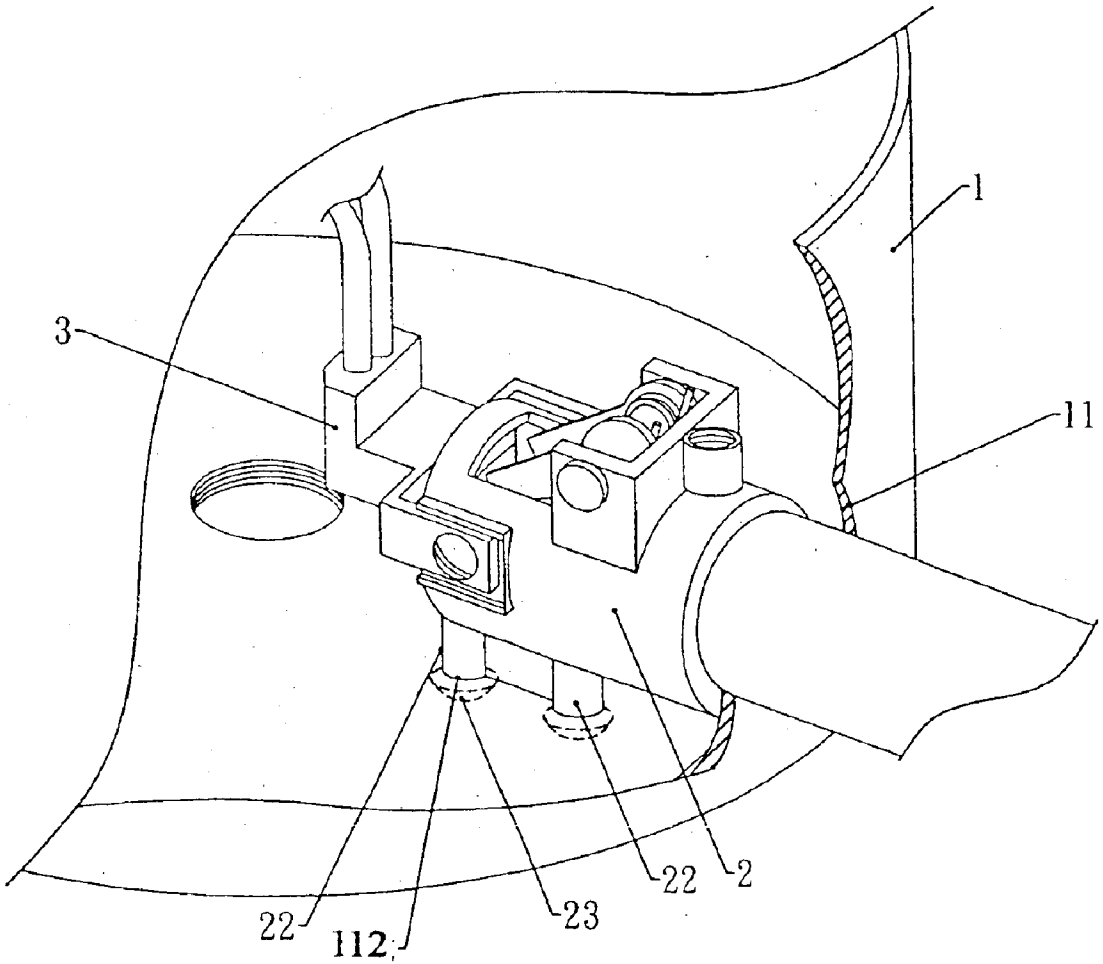
FIG. 2 is an assembled perspective view of the first embodiment of the present invention.

The First Embodiment:

Referring to FIGS. 1 and 2, the wire connecting box 1 of the present invention has a plurality of inserting holes 11. An inner side of the wire connecting box 1 has a retaining seat 2. The retaining seat 2 has a connecting hole 21 formed along an axial direction of the retaining seat 2. A lower side of the retaining seat 2 has a plurality of screw holes 22. A plurality of positioning studs 23 pass through the fixing holes 112 at a lower side of the wire connecting box 1 and then are locked into the screw holes 22. A rear side of the retaining seat 2 has a positioning hole 24 for locking a receptacle 3.

The receptacle 3 has a conductive seat 31. Two sides of the conductive seat 31 have respective through holes 32. A positioning screw 33 passes through one of the through holes 32 to be locked to the positioning hole 24 of the retaining seat 2.

The retaining seat 2 has an opening 25. Two braking pieces 26 are installed within the opening 25. A pivotal shaft 28 serves to press a torsion spring 27 to resist against the braking pieces 26 to be between two pivotal holes 29.

A rear end of the connector 4 is locket to a lamp rod 5. The lamp rod 5 may be a suspending rod of one of various types. A front end of the connector 4 is installed with a conductive head 41 and a rear end of the connector is installed with at least one braking inclined surface 42. The surface 42 may have teeth 421 for buckling a main rod 6 of a suspending lamp when inserting the suspending lamp so as to prevent the suspending lamp from dropping down. A channel 43 can be formed in a middle section of the connector 4. A front end of the channel 43 is sealed by a stop wall 431. Two sides of the channel are formed with respective via holes 44. A front end of each via hole 44 is installed with a stop edge 441.

The body of the connector 4 can be formed as a tilt surface which is matched to the connecting hole 21 of the retaining seat 2 so that as the connector 4 is embedded into the connecting hole 21, the two can be tightly engaged.

Figure 3:
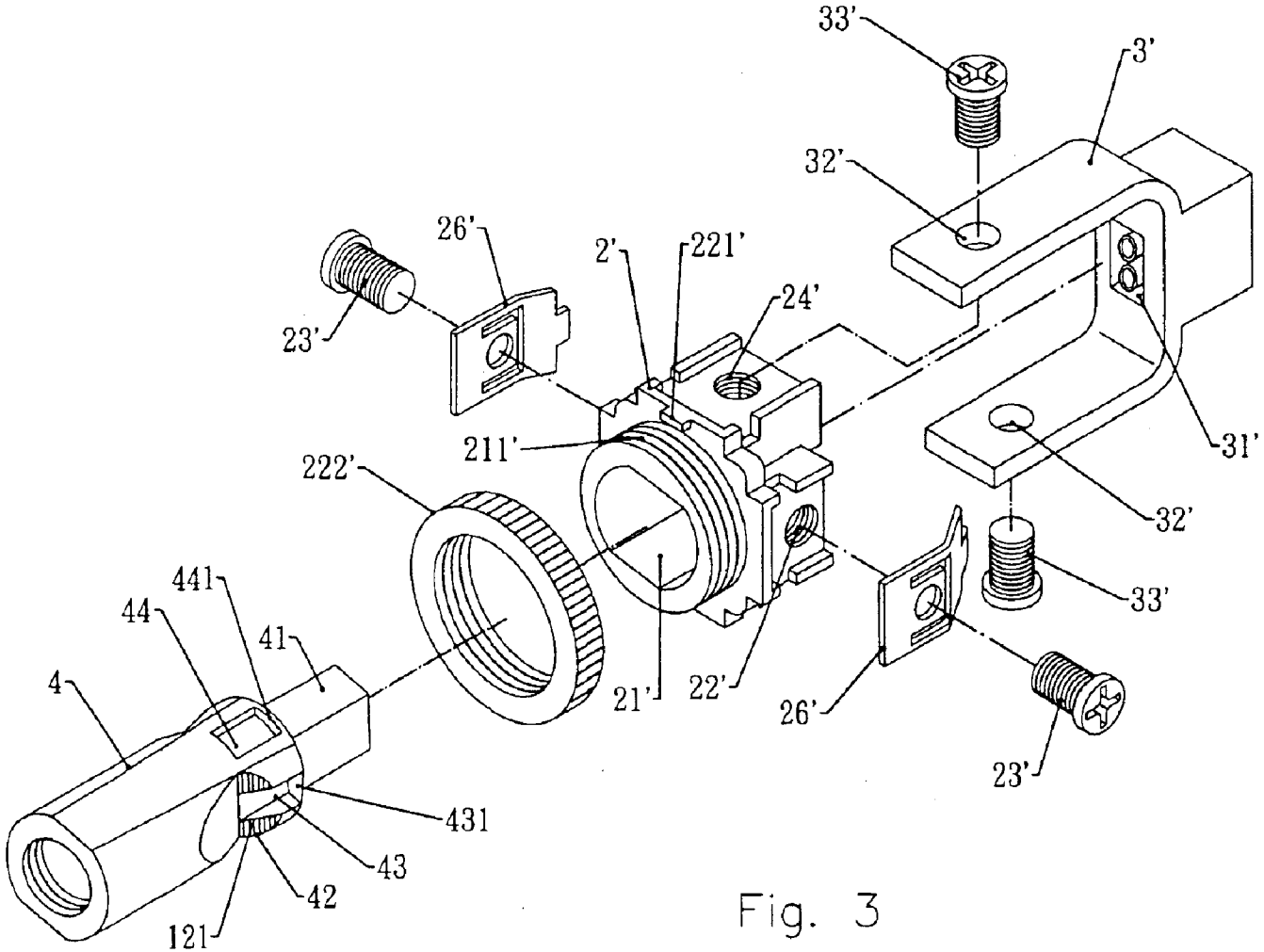
FIG. 3 is an exploded perspective view of the retaining seat in the second embodiment of the present invention.
Figure 4:
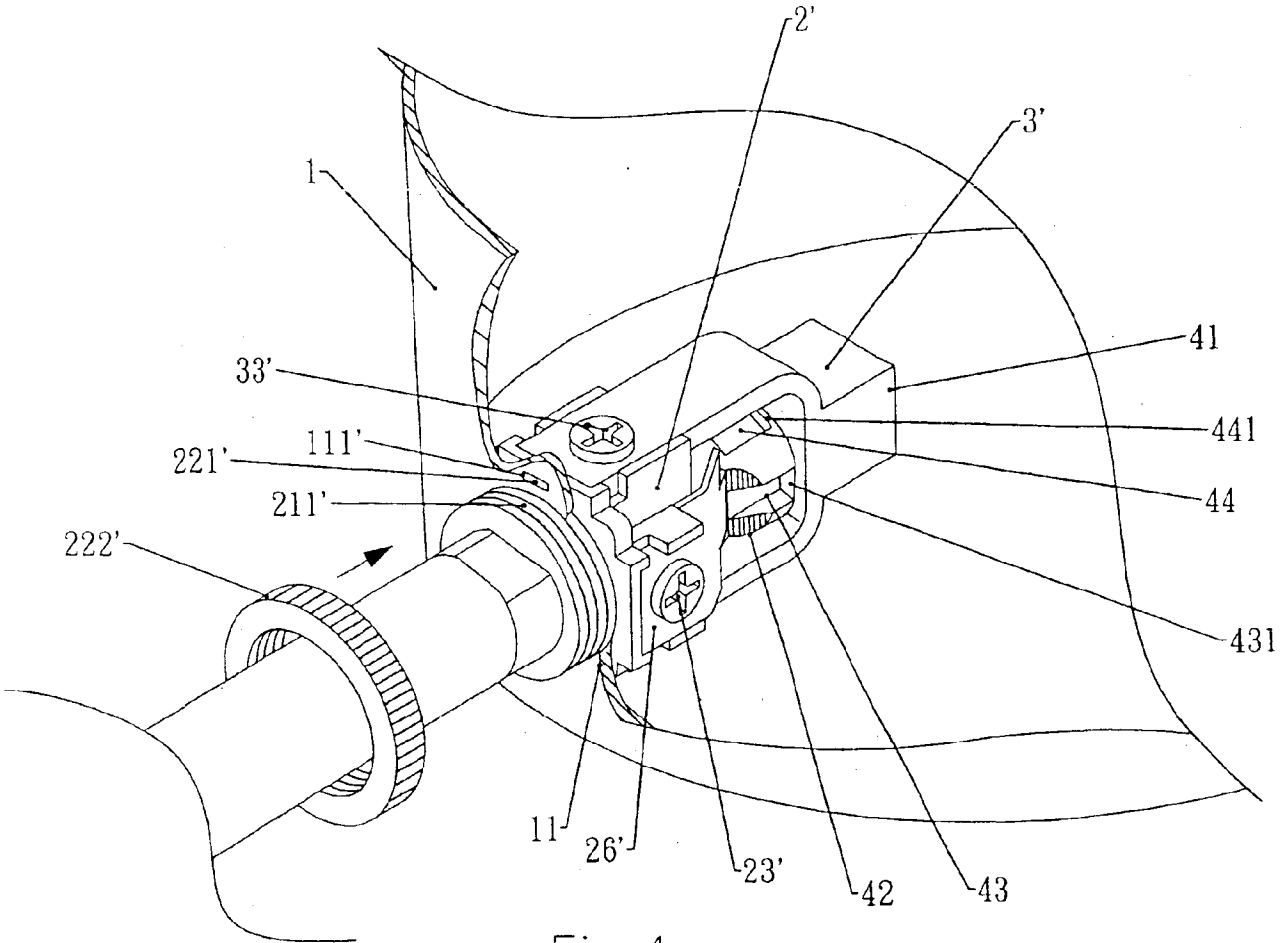
FIG. 4 is an assembled perspective view of the second embodiment of the present invention.
Figure 5:
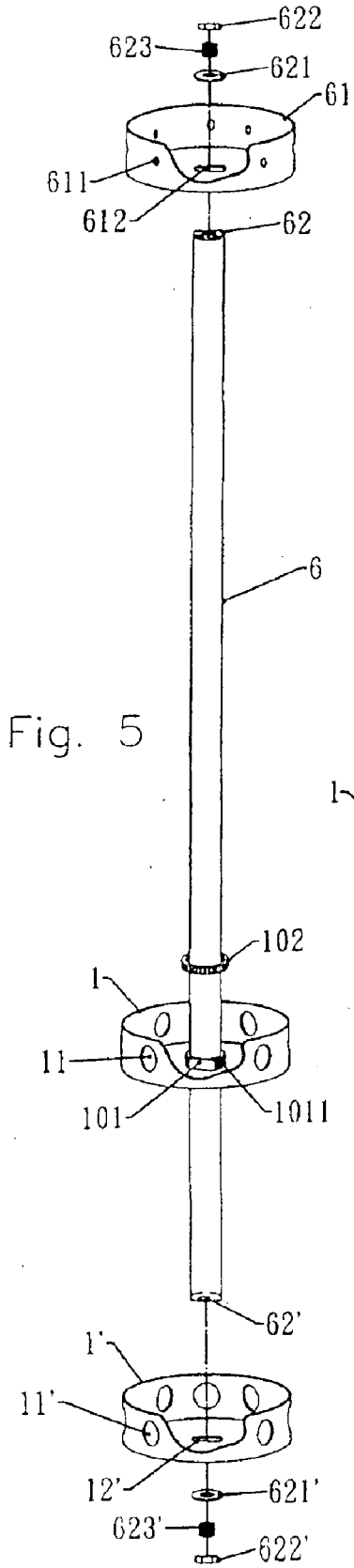
FIG. 5 is an exploded schematic view of the main rod, retaining box, and wire connecting box of the present invention.
Figure 5A:
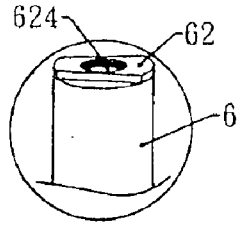
Figure 5B:
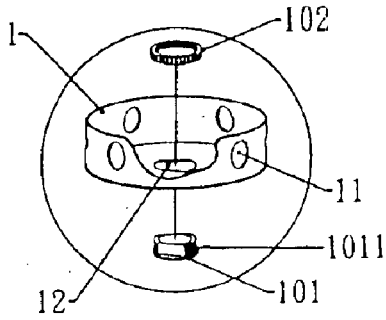
Figure 5C:
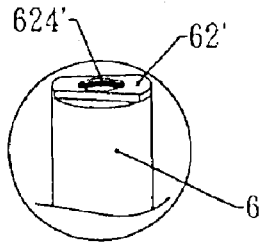

The Second Embodiment:

With reference to FIGS. 3 and 4, the wire connecting box 1 is annularly arranged with a plurality of inserting holes 11. Each inserting hole 11 is formed with a limiting hole 111'. An inner side of the inserting hole 11 is mounted with a retaining seat 2'. A front end of the retaining seat 2' is formed with a threaded tube 211'. An upper side of the threaded tube 211' is formed with a limiting block 221' configured with respect to the limiting hole 111'. Thereby, when the threaded tube 211' passes through a connecting hole 21' axially formed in the retaining seat 2', the limiting block 221' is exactly embedded into the limiting hole 111' for being positioned therein so as to prevent the retaining seat 2' from rotation. Then the retaining ring 222' is locked to the threaded tube 211' so that the retaining seat 2' is fixed to the wire connecting box 1'. Moreover, a rear side of the retaining seat 2' is installed with a positioning hole 24' for locking the receptacle 3'.

The retaining seat 2' has a braking piece 26'. A positioning stud 23' serves to lock the braking piece 26' to the threaded hole 22'.

The receptacle 3' has a conductive seat 31'. Two sides of the receptacle 3' are formed with respective through hole 32'.

A positioning screw 33' passes through one of the through hole 32' to be locked to the positioning hole 24' of the positioning seat 2'.

In this second embodiment, the connector 4' is identical to the connector 4 of the first embodiment.

In above two embodiments, when the connector 4 is embedded into the connecting holes 21 and 21'. The braking pieces 26 and 26' pass through the braking inclined surface 42 of the connector 4 so that the braking pieces 26, 26' are buckled to a bottom of the braking inclined surface 42. At the same time, the conductive head 41 is exactly embedded into the conductive seats 31, 31' of the receptacles 3, 3' so as to supply power to the lamp through the lamp rod 5. Moreover, the connector 4 is firmly secured to the lamp rod 5.

Referring to FIGS. 1A to 1F, the positioning screws 33, 33' are protruded from the wall of the connecting holes 21, 21' of the retaining seats 2, 2', or the positioning studs 23, 23' are protruded from the braking pieces 26, 26'.

Figure 6:
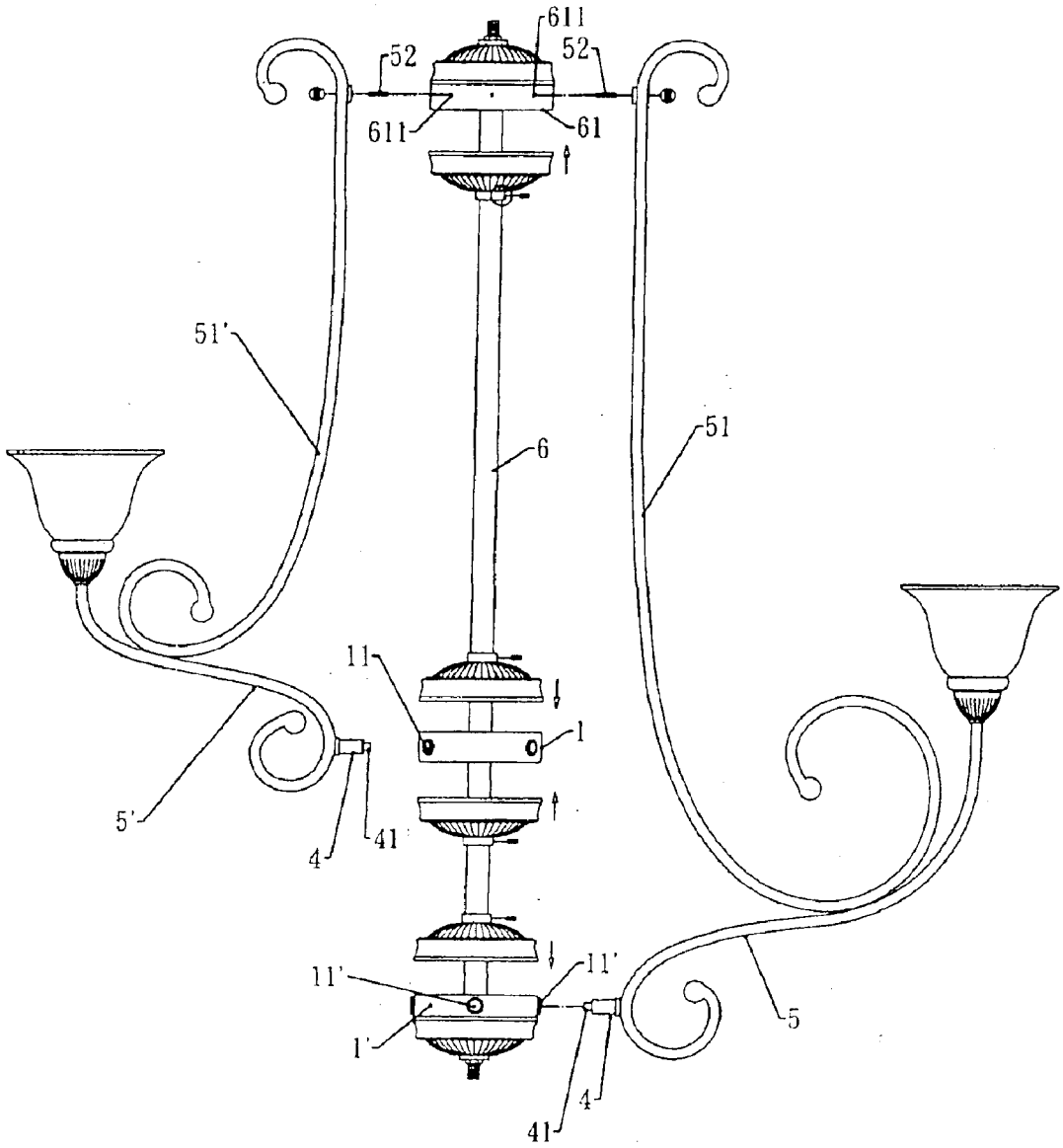
FIGS. 6 to 8 are an exploded view showing the assembly of the suspending lamp of the present invention.

Referring to FIGS. 1, 3, 1A to 1C, and 6, if the wire connecting box 1 is positioned at a position shown in FIG. 6, then the positioning screws 33, 33' are protruded from the walls of the connecting holes 21, 21'. The stop edge 441 at the front end of the via hole 44 of the connector 4 is removed, and then the connector 4 is embedded into the connecting holes 21, 21'. The positioning screws 33, 33' slide through the channel 43 so that the conductive head 41 of the connector 4 is embedded into the conductive seats 31, 31' of the receptacles 3, 3'. Further, the braking pieces 26, 26' are exactly embedded into a bottom of the braking inclined surface 42 of the connector 4.

The stop edge 441 of the via hole 44 of the connector 4 exists, and the stop wall 431 of the channel 43 is removed in advance. The connector 4 embedded into the connecting holes 21, 21' will be stopped by the positioning screws 33, 33' so that it can not be inserted further and thus the connector 4 will not enter into the connecting holes 21, 21' of the retaining seats 2, 2' of the wire connecting box 1' (referring to FIG. 6) at another stage.

Referring to FIGS. 1, 1D to 1F, 3 and 6, in this stage, as shown in FIG. 6, the stop edge 441 of the via hole 44 of the connector 4 exist, and the stop wall at the front end of the channel 43 is removed. The positioning studs 23, 23' protruded from the hole walls of the connecting holes 21, 21'. Thus the connector 4 is embedded into the connecting holes 21, 21'. The positioning studs 23, 23' will pass through the channel 43 without being hindered by the stop wall 431 so that the conductive head 41 of the connector 4 is embedded into the conductive seats 31, 31' of the receptacles 3, 3' for conduction. Moreover, the braking pieces 26, 26' exactly slide into the bottom of the braking inclined surface 42 of the connector 4 so as to be positioned therein. If it is desired to embed the connector 4 into the wire connecting box 1 (referring to FIG. 6), it will be hindered by the screws 33, 33' so that it is stopped. Thereby, the connector 4 will not enter into the connecting holes 21, 21' of the retaining seats 2, 2' of the wire connecting box 1 (referring to FIG. 6).

As described above, when the stop wall 431 of the channel 43 of the connector 4 exists, the stop edge 441 at the front end of the via hole 44 is removed in advance. Then, the connector 4 is embedded into the connecting holes 21, 21'. It will be hindered by the positioning studs 23, 23'. Thereby, the connector 4 will not enter into the connecting holes 21, 21' of the retaining seats 2, 2' of the wire connecting box 1 (referring to FIG. 6).

By above structure, the connector 4 can be correctly aligned to the wire connecting boxes 1, 1' so as to avoid the carelessness in assembly. Thereby, the present invention can be assembled and packaged rapidly with less material.

With reference to FIGS. 5, 5A to 5C and 6, an upper side of the main rod 6 of the suspending lamp is locked with a retaining box 61. A middle section and lower end of the main rod 6 are locked with respective wire connecting boxes 1, 1' at different positions. A top and a lower end of the main rod 6 are fixed with respective polygonal supporting seats 62, 62'. A middle section thereof is firmly secured with a polygonal supporting seat 101 with a thread 1011. The centers of the retaining box 61 and two wire connecting boxes 1, 1' are formed with polygonal central holes 612, 12, 12' which are configured with respect to the polygonal supporting seats 62, 101, 62' so that the retaining box 61 and the two wire connecting boxes 1, 1' are positioned on the polygonal supporting seats 62, 101, 62' by the polygonal center holes 612, 12, 12'. The retaining boxes 61 and the wire connecting box 1' are locked into the inner threaded holes of the polygonal supporting seats 62, 62' by using threaded sleeves 623, 623'. Washers 621, 621' enclose the threaded sleeves 623, 623'. Nuts 622, 622' lock the threaded sleeves 623, 623' and then resists against the washers 621, 621' so as to fix the retaining box 61 and the wire connecting box 1' to the two ends of the main rod 6. Furthermore, the wire connecting box 1 at the middle section is locked to the thread 1011 of the polygonal supporting seat 101 by a nut 102 so as to fix the wire connecting box 1 to the middle section of the main rod 6.

Figure 7:
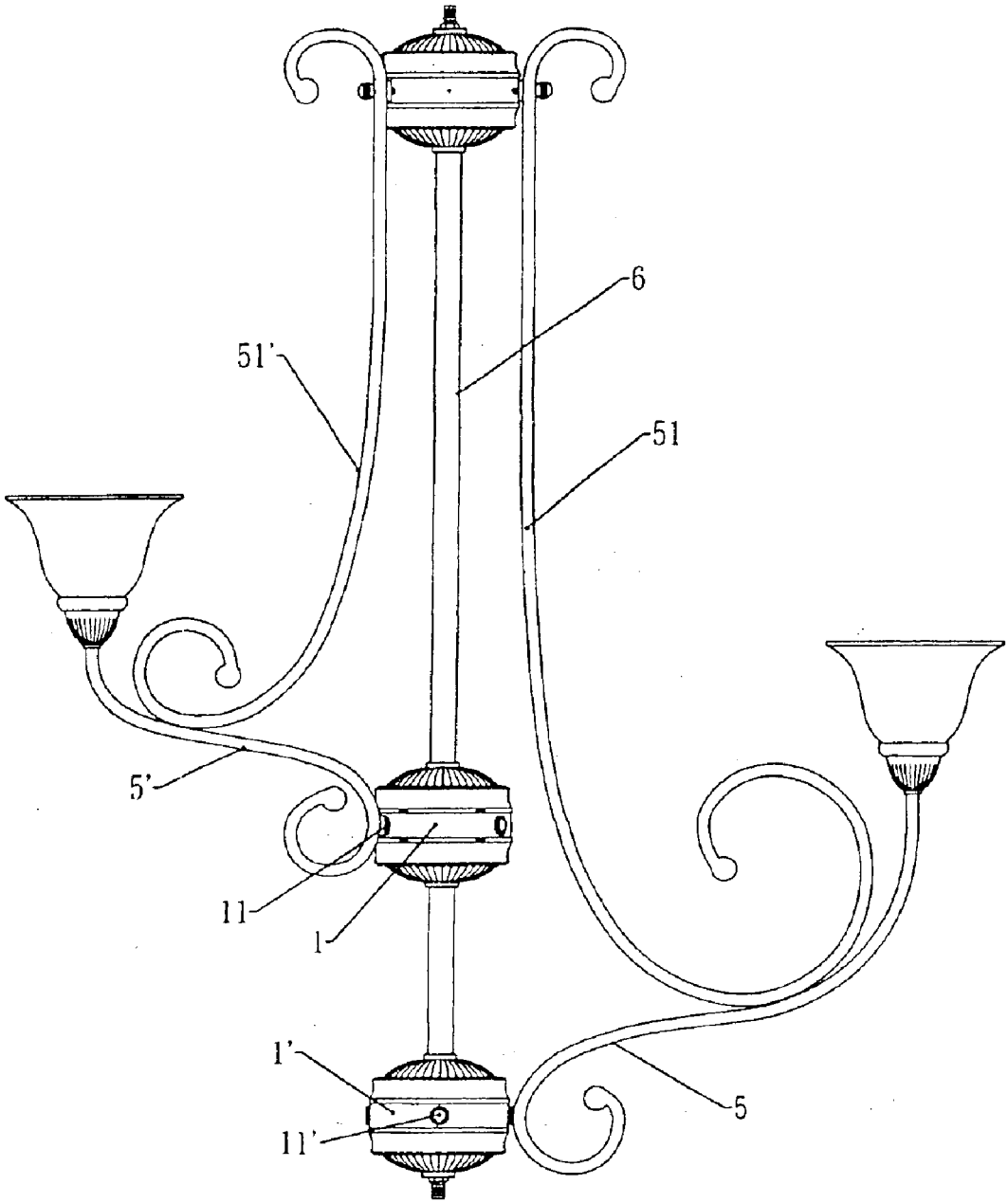

Referring to FIGS. 6, 6A and 7, each stub 51 of the lamp rod 5 has a fixing screw 52. The fixing screw 52 serves to lock the stub 51 to the screw hole 611 of the retaining box 61.

After assembly the retaining box and the wire connecting boxes 1, 1', the screw hole 611 of the retaining box 61 is vertically aligned to the inserting hole 11, 11' of the multiple layer wire connecting boxes 1, 1'. The inserting holes 11, 11' of the wire connecting boxes 1, 1' in different stages are not aligned.

Figure 8:
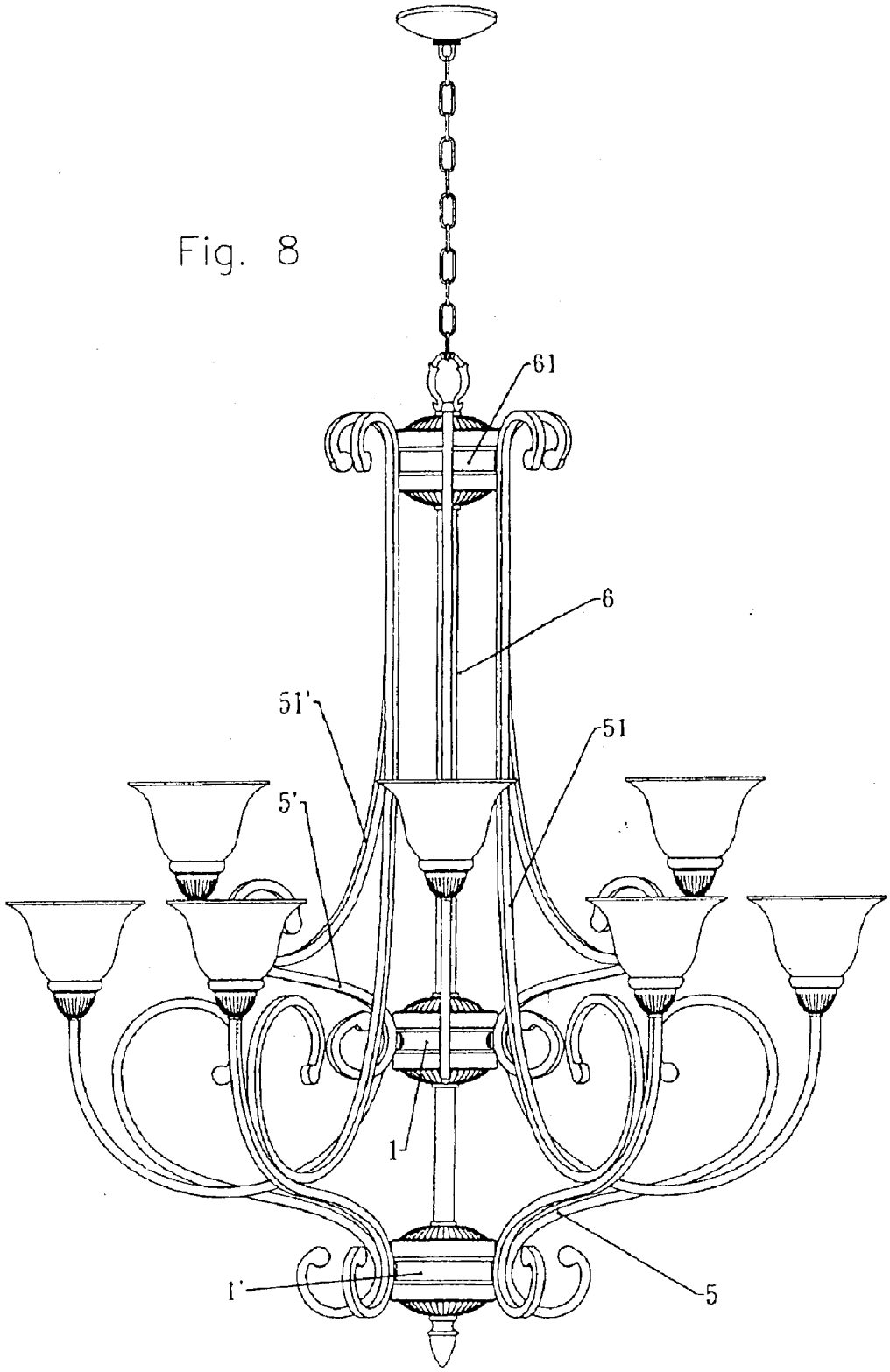

Referring to FIGS. 8, 1, and 3, according to above structure, the electric connecting structure for a lamp of the present invention can be formed. In assembly, by the mounting of the positioning screws 33, 33', the walls of the connecting holes 21, 21' of the positioning studs 23, 23', and the channel 43 and the stop wall 431 of the connector 4, and by the removing of the stop wall 431 or stop edge 441, the connector 4 and the retaining seats 2, 2' are not installed incorrectly. Thereby, the work of package is easy and cost is thus saved.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An electric connecting structure for a lamp for assembling a lamp rod and wire connecting boxes; comprising:

a plurality of wire connecting boxes; each of the wire connecting box having a plurality of inserting holes annularly arranged around a periphery of the wire connecting box;

a plurality of retaining seats; an inner side of each wire connecting box being installed with a respective retaining seat; a connecting hole being formed axially in the retaining seat; each of the retaining seats being locked to one inserting hole of each wire connecting box through a positioning stud;

a receptacle at rear sides of retaining seats; a conductive seat being installed in the receptacle; each of two sides of the receptacle having a through hole; a positioning screw passing through each of the through hole so as to lock the receptacle into the positioning holes of the retaining seats;

a plurality of braking pieces; each braking piece being mounted to a respective retaining seat;

a plurality of connectors; a rear end of each connector being locked to a lamp rod; each connector having a braking inclined surface at a rear side thereof; a channel being formed at a middle section of the braking inclined surface; a front end of the channel having a stop wall; each of the two sides of the channel being formed with at least one via hole; and the front end thereof having a stop edge;

wherein each connector is embedded into a connecting hole of the retaining seat; and the braking pieces are buckled to a bottom of the braking inclined surface so that the connector is positioned firmly;

the positioning studs and positioning screws are protruded from the wall of the connecting holes based on positions of the wire connecting boxes;

the stop wall of the channel of the connector is at a position with respect to the positioning studs on the wall of the connecting holes of the retaining seats; in assembly, the stop wall is removed so that the positioning studs of the wire connecting box in that position slide through the channel, but can not slide through the positioning screws of another wire connecting box at another position;

the step edge at the via hole of each connector is configured with respect to the positioning screws at the connecting hole of each retaining seat; in assembly, the stop edge is removed, so that the positioning screws of the wire connecting box in that position slides through the via hole, but can not slide through the positioning stud of another wire connecting box at another position;

therefore, the electric connecting structure for a lamp is formed by above components and assembly way, furthermore, in assembly, the lamp rod is inserted into the wire connecting box so that the connector and the retaining seat are connected correctly.

2. The electric connecting structure for a lamp as claimed in claim 1, wherein the retaining seat has an opening; two braking pieces are installed within the opening; a pivotal shaft serves to press a torsion spring to resist against the braking pieces to be between two pivotal holes in the retaining seat.

3. The electric connecting structure for a lamp as claimed in claim 1, wherein each retaining seat has at least one braking piece which is locked to the retaining seat by a positioning stud.

4. The electric connecting structure for a lamp as claimed in claim 1, wherein the connector has a tilting surface; and the connecting hole of the retaining seat has a titling inner hole having a configuration with respect to the tilt surface, when the connector is embedded into the connecting hole; the connector and the retaining seat are engaged firmly.

5. The electric connecting structure for a lamp as claimed in claim 1, wherein the braking inclined surface of the connector is formed with teeth for buckling the braking piece in inserting the connector.

6. The electric connecting structure for a lamp as claimed in claim 1, wherein the connector has a plurality of channels and via holes which are formed with plurality of positioning studs and positioning screws, respectively, so that the wire connecting boxes are positioned at different positions, thereby, the connector and retaining seat are combined correctly.

7. An electric connecting structure for a lamp comprising a main rod, a plurality of stubs, a retaining box, and a plurality of wire connecting boxes positioned at different positions of the main rod; wherein an upper side of the main rod locked with a retaining box; a middle section and a lower end of the main rod are locked with respective wire connecting boxes; characterized in that:

a top and a lower end of the main rod are fixed with respective polygonal supporting seats; a middle section thereof is firmly secured with a polygonal supporting seat with a thread; the centers of the retaining box and two wire connecting boxes are formed with polygonal central holes which are configured with respect to the polygonal supporting seats so that the retaining box and the two wire connecting boxes are positioned on the two polygonal supporting seats by the polygonal center holes thereof; the retaining boxes and the wire connecting box are locked into inner threaded holes of the polygonal supporting seats by using threaded sleeves; a washer encloses the threaded sleeves; nuts lock the threaded sleeves and then resist against the washer so as to fix the retaining box and the wire connecting box to the two ends of the main rod, furthermore, the wire connecting box at the middle section is locked to the thread of the polygonal supporting seat by a nut so as to fix the wire connecting box to the middle section of the main rod.

* * * * *